US012312881B2

(12) United States Patent
Owoeye et al.

(10) Patent No.: US 12,312,881 B2
(45) Date of Patent: May 27, 2025

(54) INTELLIGENT POWERSLIP AND POWER LOCK SYSTEM FOR RUNNING AND RETRIEVING TUBULARS FROM A WELLBORE

(71) Applicant: Saudi Arabian Oil Company, Dhahran (SA)

(72) Inventors: Oladele Owoeye, Dhahran (SA); Ayodeji Abegunde, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/466,352

(22) Filed: Sep. 3, 2021

(65) Prior Publication Data

US 2023/0074177 A1 Mar. 9, 2023

(51) Int. Cl.

| | |
|---|---|
| ***E21B 19/10*** | (2006.01) |
| ***E21B 19/06*** | (2006.01) |
| ***E21B 19/16*** | (2006.01) |
| ***E21B 41/00*** | (2006.01) |

(52) U.S. Cl.

CPC ..... *E21B 19/10* (2013.01); *E21B 19/165* (2013.01); *E21B 41/0021* (2013.01); *E21B 19/06* (2013.01)

(58) Field of Classification Search

CPC ..... E21B 19/10; E21B 19/102; E21B 19/165; E21B 19/06; E21B 19/16

See application file for complete search history.

(56) References Cited

U.S. PATENT DOCUMENTS

| | | | | |
|---|---|---|---|---|
| 2,829,617 | A * | 4/1958 | Kelley | E21B 19/10 24/265 R |
| 3,457,605 | A | 7/1969 | Kingsbury et al. | |
| 5,791,410 | A * | 8/1998 | Castille | E21B 19/10 166/77.4 |
| 7,182,133 | B2 * | 2/2007 | Webre | E21B 19/07 166/250.01 |
| 7,419,008 | B2 | 9/2008 | Campisi et al. | |
| 8,136,603 | B2 * | 3/2012 | Schneider | E21B 19/10 166/85.1 |
| 8,356,675 | B2 | 1/2013 | Pietras et al. | |
| 9,903,167 | B2 * | 2/2018 | Dewald | E21B 19/07 |
| 10,801,278 | B2 * | 10/2020 | Zheng | E21B 19/10 |
| 11,428,057 | B2 * | 8/2022 | Moberg | E21B 19/165 |

(Continued)

OTHER PUBLICATIONS

Hoffman, "Definition of Terms—Hydraulics", 2006, accessed vai web.archive.org (Year: 2006).*

*Primary Examiner* — Blake Michener

(74) *Attorney, Agent, or Firm* — Fish & Richardson P.C.

(57) ABSTRACT

Systems and methods include a computer-implemented method for the operation of an intelligent powerslip including interfacing with a powerlock system. Measurements from multiple sensors are monitored using an interface between a powerlock and a powerslip of a well. The measurements measure weights, pressures, and temperatures corresponding to use of the powerslip and a grappling device during operation of the well. The measurements from the multiple sensors are compared to pre-determined tolerances to verify that an appropriate engagement exists between the tubular, powerlock and the powerslip. In response to verifying the appropriate engagement and logic, either one of the grappling device or the powerslip can be released depending on the ongoing operation.

17 Claims, 5 Drawing Sheets

(56) References Cited

U.S. PATENT DOCUMENTS

| | | | | |
|---|---|---|---|---|
| 2002/0170720 | A1* | 11/2002 | Haugen | E21B 19/00 166/380 |
| 2004/0188098 | A1* | 9/2004 | Schulze-Beckinghausen | E21B 44/02 166/380 |
| 2007/0131416 | A1* | 6/2007 | Odell, II | E21B 19/06 166/250.1 |
| 2008/0264648 | A1* | 10/2008 | Pietras | E21B 41/0021 166/85.1 |
| 2009/0272542 | A1 | 11/2009 | Begnaud et al. | |
| 2011/0048737 | A1* | 3/2011 | Schneider | E21B 41/0021 166/380 |
| 2011/0114308 | A1* | 5/2011 | Nikiforuk | E21B 19/086 166/380 |
| 2012/0043071 | A1* | 2/2012 | Matherne, Jr. | E21B 19/10 166/77.53 |
| 2012/0055682 | A1* | 3/2012 | Bouligny | E21B 44/00 166/380 |
| 2013/0118760 | A1* | 5/2013 | Kuttel | E21B 19/06 166/85.1 |
| 2014/0041854 | A1* | 2/2014 | Robichaux | E21B 19/07 166/77.52 |
| 2015/0091737 | A1* | 4/2015 | Richardson | E21B 47/00 340/853.2 |
| 2015/0315855 | A1* | 11/2015 | Dewald | E21B 33/0422 166/250.01 |
| 2017/0247234 | A1* | 8/2017 | Guidry | B66C 1/445 |
| 2019/0257161 | A1 | 8/2019 | Dewald et al. | |
| 2020/0326226 | A1* | 10/2020 | Camacho Cardenas | E21B 19/00 |
| 2022/0154540 | A1* | 5/2022 | Slack | E21B 31/18 |
| 2022/0268113 | A1* | 8/2022 | Owoeye | E21B 19/10 |

* cited by examiner

INTELLIGENT POWERSLIP AND POWER LOCK SYSTEM FOR RUNNING AND RETRIEVING TUBULARS FROM A WELLBORE

TECHNICAL FIELD

The present disclosure applies to powerslips used for drilling in the petroleum industry.

BACKGROUND

Slips used in the petroleum industry are devices used to grip and hold the upper part of a drill string of an oil rig. The slips can include metal components that are hinged together to form a circular shape around a drill pipe. Slips are part of the machinery used to make up or break out tubulars.

SUMMARY

The present disclosure describes techniques that can be used for the operation of an intelligent powerslip including interfacing with a powerlock system. In some implementations, a computer-implemented method includes the following. Measurements from multiple sensors are monitored using an interface between a powerlock and a powerslip of a well. The measurements measure weights, pressures, and temperatures corresponding to use of the powerslip and a grappling device during operation of the well. The measurements from the multiple sensors are compared to predetermined tolerances to verify that an appropriate engagement exists between the tubular and the powerslip and grappling device. In response to verifying the appropriate engagement and logic, either one of the grappling device or the powerslip can be released depending on the next activity.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Human error can be eliminated that is associated with tripping tubulars that may result in tubulars dropping in hole. Limitations of existing commercial interlocks can be eliminated through the inclusion of failsafe logic in a programmable logic controller (PLC). The logic can ensure, for example, that a power lock system will prevent the release of the handling tool if full weight has not been transferred to the powerslip and if there is no confirmation of full engagement of the slip. This can eliminate incidents of casing slipping and dropping in the hole with the interlock system in use when the powerslip is closed on an obstruction not limited, for example, to connections and centralizers. A fully-automated powerslip system can monitor input and output signals, detect full travel of the piston, and provide diagnostics. A smart system can monitor weight transfer, track piston movement and line pressure, and provide a failsafe system for decision making regarding when to disengage the handling tool, thereby resolving the recurring casing slip and drop problems during operation. Human error and miscommunication between the casing crew and the driller can be eliminated. Health and Safety exposure (HSE) of the running crew can be reduced by removing hands and ensuring decent work heights on the rig floor. This can eliminate human error in tripping operations and can improve the current limitations of the existing interlock systems in the market where the interlock system will function as long as the Flush Mounted Spider (FMS) engage function has been activated yet not confirmed as functioned. Problems associated with communications between the driller and FMS or Case Running Tool (CRT) operator can be reduced. This can occur as the system is automated to monitor the full weight transfer from the tubular handling tool or CRT/CDS to the powerslip rather than relying on the slacking off the weight on the FMS by the driller and communication with the CRT Operator before disengaging the handling tool. Piston position can be monitored and fluid volume and pressure can be checked to confirm that a pipe is fully engaged. Full weight transfer from the handling tool can be confirmed before activating the release function from the running tool, CRT, or Casing Drive System (CDS).

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1A:
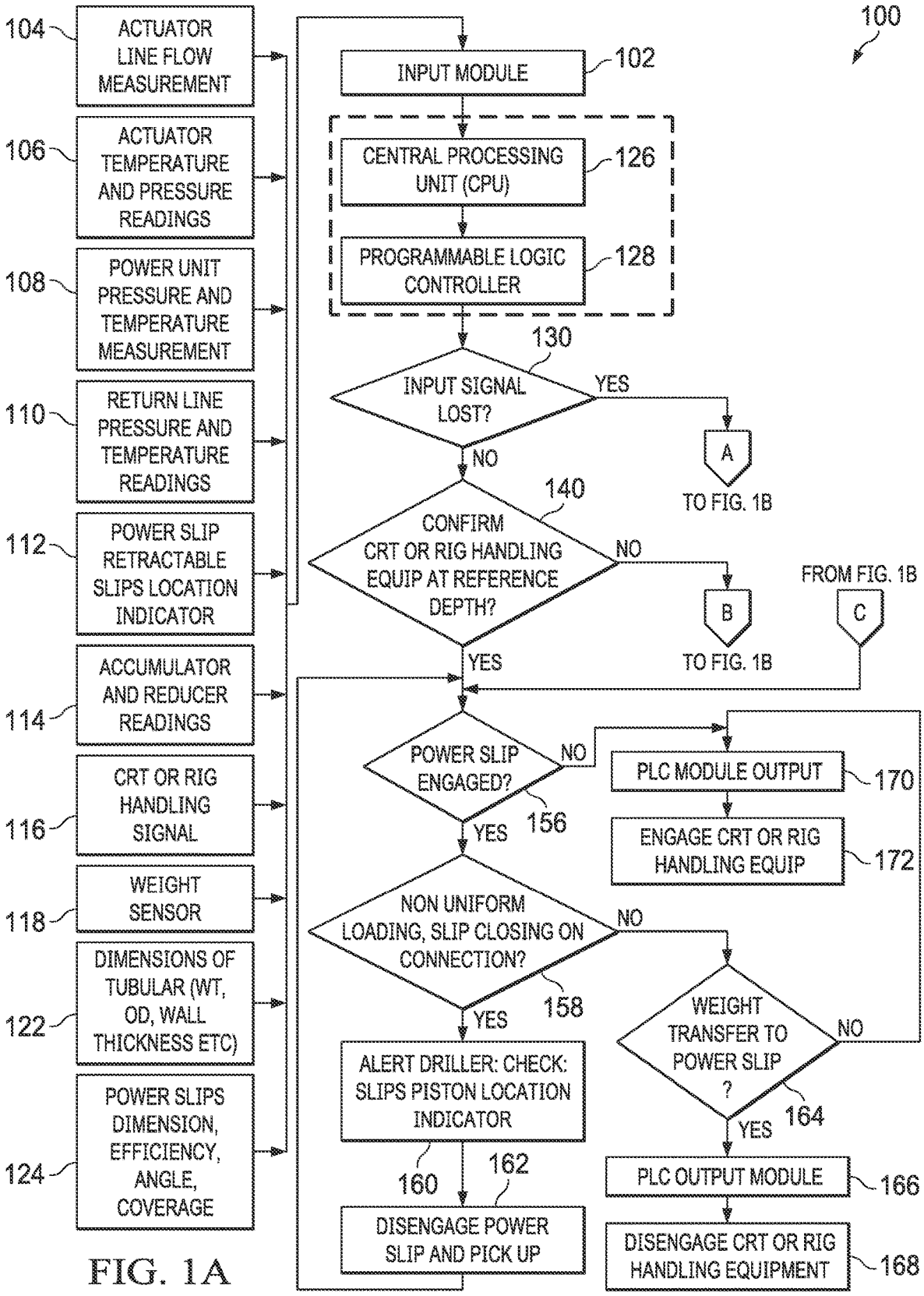
FIGS. 1A and 1B are flow diagrams collectively showing an example of a workflow showing an intelligent powerslip system in Run mode, according to some implementations of the present disclosure.

The following detailed description describes techniques for the operation of an intelligent powerslip including interfacing with a powerlock system. For example, the present disclosure describes providing necessary failsafe logic with the intelligent power slip and the power lock to prevent a casing from slipping and dropping in hole when the casing running tool or handling tool is released.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

An integrated programmable logic controller (PLC) can review a combination of engagement (slip up) measurements to confirm engagement of the powerslip such as Slip Up pressure measurement, fluid flow measurement, and location sensor on the power slip retractable slips. The combination of this measurement can be compared with the required pressure measurement and fluid volume for the given tubular size. The approach is able to detect anomalies in the powerslip engagement which are not provided by conventional powerslip systems. A visual display can be presented to the powerslip operator of possible misalignment of slips, a leak in an actuator, insufficient pressure to the retractable slip (which affects the gripping capacity), slips closing on a connector or a centralizer, non-uniform engagement of the slips, which can cause slip crushing (inside diameter restriction in the tubular), and detection of wear on the retractable slips. These types of anomalies can result in potential casing slip and drop in hole when a tubular handling tool is released, even with an interlock system that is in use. This type of incident has occurred several times in operations while using the interlock systems of several service providers with the casing running tool.

The PLC can monitor the weight transfer between the grappling device and the power slip, while not allowing release of the grappling device if the string weight has not been fully transferred to the powerslip. For example, the release of the grappling device from the tubular will not be permitted (even if the Slips Up have been confirmed by the PLC) if the weight has not been fully transferred from the grappling device to the Powerslip in the rotary table.

In some implementations, the powerlock system will not permit the release of the grapple device from the tubular even if the two criteria stated above are met (for example, Slips fully engaged and weight transferred to the slips effected) if the tubular with the grappling device is not at reference depth equivalent to slips setting position. This additional safety feature can eliminate working at heights (if required) and dropped objects. This additional safety feature can also reduce the risk of string buckling in the derrick when transferring weight between the grappling device and the powerslip when tubular is not at reference slip setting depth.

In some implementations, an intelligent powerslip and power lock system (IPPLS) (or "system") of the present disclosure can serve as a smart tubular deployment system ensuring that the state of two mechanisms or functions are mutually dependent. The dependency can be based at least in part on a logic function. Conditions provided by the two mechanisms considered are not limited to "Case running tool (CRT) or rig handling tool not engaged" to "Tubular and powerslip in a Slip Up position." The conditions can also include "Elevator tilt arm on CRT not activated with powerslip in Slip Up position," "Rig handling tool not engaged," and "Powerslip in Slip Up position."

The PLC can monitor various input sensing devices such as weight sensors, location indicator sensors of the retractable slips, pressure and temperature sensors from actuator control lines, pressure and temperature readings on power units, return lines, powerslips, manifolds, accumulators and reducers, and fluid flow measurement. Based on the monitoring, the PLC can produce corresponding output, which ultimately functions to either keep the powerslip in Slip Up or Slip Down positions in order to engage or disengage the tubular as required.

While running or retrieving tubulars from the wellbore with the pipe in slip position on the derrick with the Slip Up function engaged, a central processing unit (CPU) of the IPPLS execute application programs, perform internal diagnostics, and communicate the outcome to an output module. An output device can cause execution of a particular function by sending an output command to an actuator. Output commands can include, for example, electrical, mechanical, hydraulic, or pneumatic commands, or a combination of such commands. The actuator can function to keep slips engaged to tubular (or slips up). A power unit valve or switch can be operated, and one or more control lines can be available to supply fluid to one or more annular piston assemblies. The power unit valve or switch can include a monitoring line to transmit information or data back to the PLC input module. This can allow the operator or the PLC to monitor the conditions in the fluid chamber including but not limited to pressure and temperature within the chamber.

Similarly, when the Slip Down function is engaged, the CPU can execute the application program, perform internal diagnostics, and communicate outcomes to the output module. An output device can execute the function, for example, by sending an output command to an actuator. Commands be electrical, mechanical, hydraulic, or pneumatic, or in some combination. The actuator can function to keep slips disengaged from the tubular (in a Slip Down position). The PLC can monitor and ensure that the Slips are fully retracted to an initial position. This can provide full bore access for running or retrieving the next string of casing while ensuring there is no obstruction when running or retrieving the next string of tubular. Similarly, the PLC's can continuously read and monitor the position of the slips. The position can be compared with the preset Slip Down position, thus providing feedback to the operator, for example, that the slip is fully retracted. The feedback can be in the form of an audible sound (for example, an alarm), a visual (such as a light), or both.

Figure 1B:
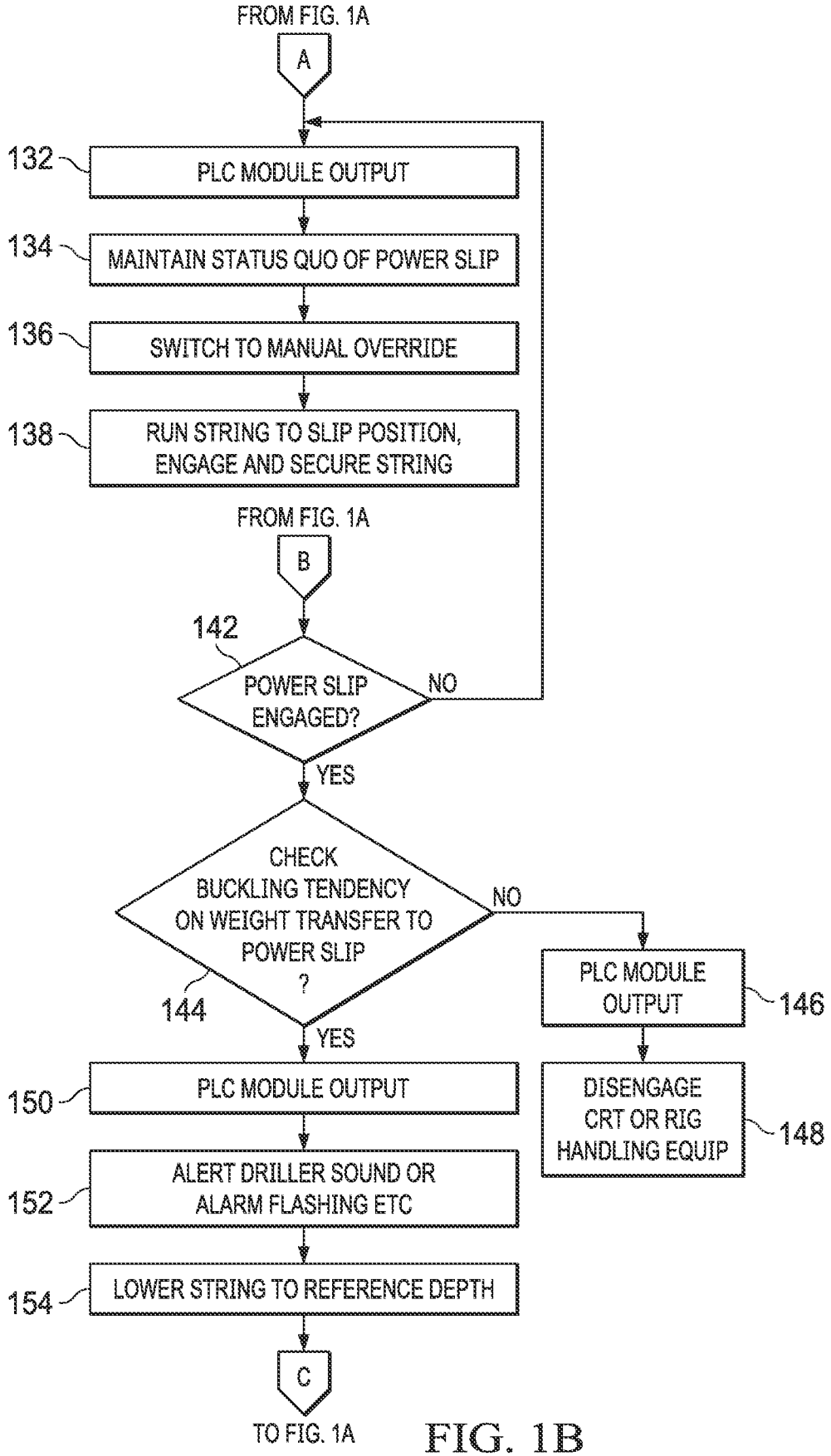

FIGS. 1A and 1B are flow diagrams collectively showing an example of a workflow 100 showing an intelligent powerslip system in Run mode (e.g., in either Slip Up or Slip Down position) according to some implementations of the present disclosure. The workflow 100 can be used by the IPPLS to monitor for the existence of leaks in the actuator chamber or the pressure required to engage the tubular in the Slips Up or Down position. The IPPLS can also monitor the volume of fluid pumped for an hydraulic system in comparison to the volume required to function for a given tubular size.

An input module 102 can process inputs including, for example, actuator flow line measurements 104, actuator temperature and pressure readings 106, power unit pressure and temperature measurements 108, return line pressure and temperature readings 110, a powerslip retractable slips location indicator 112, accumulator and reducer readings 114, CRT and rig handling signals 116, weight sensors 118, dimensions of tubulars 122 (for example, including weight, outside dimension (OD), and wall thicknesses), and power slips dimensions, efficiency, and angle coverage 124. The input module 102 can provide information from the inputs to a central processing unit (126) and a programmable logic controller (PLC) 128. At 130, a determination can be made whether the input signal is lost. If the input signal is lost, then the PLC module output 132 can be invoked, to maintain (134) the status quo of the power slip, switch (136) to manual override, and run (138) the string to slip position, and engage and secure the string.

If at 130, the input signal is not lost, then at 140, a confirmation occurs whether the CRT or rig handling equipment is at the reference depth. If not, then at 142 a determination is made whether power slip is engaged 142. If not, then processing resumes at 132. If the power slip is engaged at 142, then at 144 a check is made of the buckling tendency on weight transfer to the slip. If not, then at 146, the PLC output generates a message 148 to disregard the CRT or rig handling equipment.

If at 144, buckling tendency is confirmed, then at 150 the PLC output produces an alert 152 to the driller, sounding an alarm or flashing a light. Then, at 154, the string is lowered to a reference depth.

If at 140, a confirmation occurs whether equipment is at the reference depth, then at 156, a determination is made whether the power slip is engaged 156. If the power slip is not engaged, then the PLC module outputs (170) a message to engage the CRT or the rig handling equipment. If the power slip is engaged, then a determination is made at 164 whether the weight is transferred to the power slip. If the weight is not transferred at 164, then the PLC module outputs (170) a message (172) to engage the CRT or the rig handling equipment. If the weight is transferred at 164, then the PLC module outputs (166) a message 168 to disengage the CRT or the rig handling equipment.

If at 156, a determination is made that the power slip is engaged, then at 158 a determination is made at 158 whether non-uniform loading, slip closing on the connection is occurring. If so, then the driller is alerted at 160 to check the slip's piston location indicator, and at 162, the powerslip is disengaged and picked up.

If at 158, if non-uniform loading, slip closing on the connection is not occurring, then at 164, a determination is made whether weight transfer has occurred to the power slip. If not, then the PLC module outputs (170) a message to engage the CRT or the rig handling equipment.

A PLC can continuously read and monitor the status of the weight hanging in the Powerslip during the operation. The result can be compared with a hook loadless travelling block weight and any other tool used to deploy the tubular.

Feedback can be provided to an operator, for example, when the weight has been transferred to the powerslip at Slips Up position. Feedback provided to the operator can be in the form of an alarm, a light, or both. The feedback can help to ensure that the driller does not release the handling or running tool when the weight of the string has not been fully transferred to the powerslip. This can help to prevent the tubular from slipping or dropping in hole.

When intelligent Powerslip system is run with the smart CRT/CDS, the weight sensor on the Powerslip can communicate with wireless weight sensor on the CRT/CDS and provide a positive indication when weight is transferred from the CRT/CDS to the Powerslip. However, when deployed as a standalone running tool, the hook load can be provided as an input into the system. The system can be configured to link up with the TDS telemetry, a wireless weight sensor on the TDS, or a rig handling system or any other system that is able to monitor the hook load of the tubular during deployment.

A piston movement tracking system (implemented as a solid state magnetic field sensor or Hall effect sensor, strain gauge or any proximity sensor) can be incorporated with the slips and the actuators (for example, a piston and cylinder assembly). The tracking system can be integrated with the PLC and can provide the ability to monitor the movement of the actuator piston rod. As a result, the PLC can monitor engagement (Slip Up) and disengagement (Slip Down) of the powerslip for the given tubular size in addition to the pressure and temperature in real time.

The tracking system can track the position of the piston in relation to the final position for a given tubular size, thereby tracking the position of the slips and detecting any anomaly in the Slips Up or Slip Down position. The final slip position of the powerslip for the given tubular size can be pre-set at the start of the tripping operation. Anomalies that can be identified are not limited to: 1) Slips not well seated, 2) Partial extension of the slip inward to engage or outward to disengage, 3) Damage to a piston which would mean the slip is not responding thereby resulting in non-uniform loading of the slips on the tubular, 4) Slips gripping on collar or connection rather than tubular, and 5) Slips gripping centralizer rather than tubular. The tracking system can send and/or receive an electric signal, hydraulic signal, or a pneumatic signal to the PLC, depending on the type of actuator system.

The lateral load exerted by the gripping element on the tubular based can be computed based on the real-time position of the gripping element and the weight hanging below hanging from the powerslip. The lateral load can be compared with the expected lateral force in case of full coverage. This can result in an output signal which will trigger an audible or flashing (or both) on the power unit to signify the abnormality in the gripping efficiency of the powerslip. The output signal can occur if, for example, the threshold set by the powerslip operator for pipe crushing is exceeded or non-uniform loading of the slip mechanism on the tubular is detected. This will help reduce the risk of slip crushing while running heavy and long casing or buckling when weight is transferred to the powerslip with the tubular not at the required reference slip position as well as reduce the risk of tubular slipping and dropping in hole.

The combinational use of a powerslip system, a power lock, and a PLC can make it possible to maintain a status quo when a signal is lost, such as to maintain the pressure required to keep the slips engaged (if being engaged was the status quo). When the input signal to the PLC is lost in the Slip Up position, for example, the default mode will be for the PLC to communicate the outcome to the output module. This can trigger execution of a command to maintain the power unit valve or switch in its previous position. For example, the previous position can refer to before a loss of signal (e.g., slips engaged to the tubular). If the valve or switch was open, the system can ensure that the actuator keeps the slips engaged to the tubular in spite of any loss of signal.

A manual override can be used to take control of the powerslip system by switching off the PLC from Run mode and Slip Up position. The override can occur if there is a loss of signal or communication to the PLC and it is desired to disengage the slips and run or retrieve the next tubular string. In cases in which the signal is lost in Slip Down mode, the PLC can trigger an alarm to highlight that there is no weight supported by the powerslip and the driller should remain engaged to the tubular with the running or handling tool. Similarly, a manual override can be incorporated to take control of the powerslip by switching off the PLC from Run mode in Slip Down position to Slip Up position. The override can occur if there is a loss of signal or communication allowing the operator to engage the tubular in Slip Up position. However, a loss of signal can cause a loss in the ability to monitor the weight transfer to the powerslip in Slip Down mode. In this situation, attempts should be made to regain signal to ensure the full functionality of the system.

Figure 2:
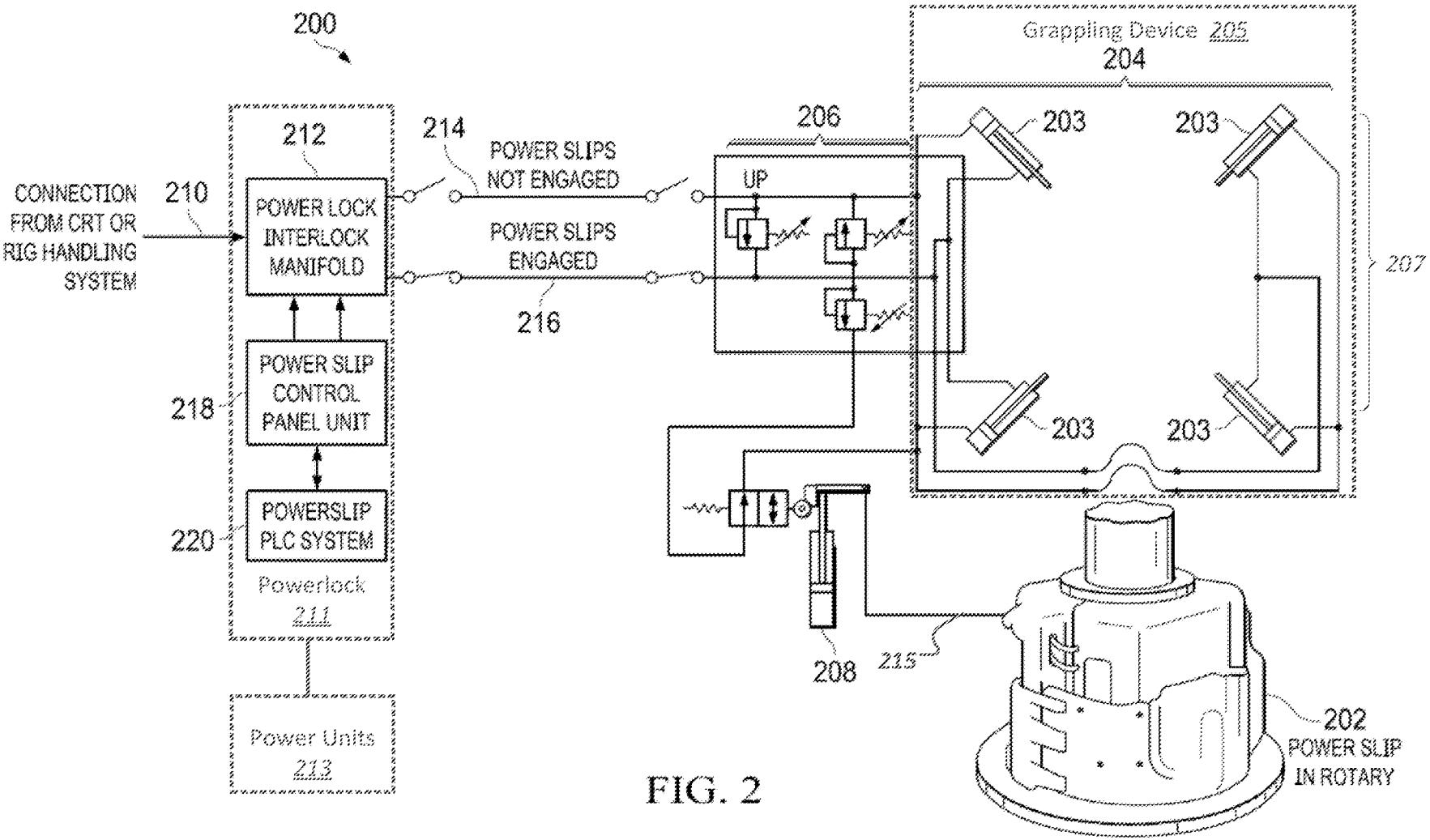
FIG. 2 is a schematic diagram showing an example of a powerslip system set up as a power lock and powerslip PLC system, according to some implementations of the present disclosure.

A powerslip interlock system can be integrated with the powerslip and any tubular running tool (hydraulic or mechanical) or rig handling tool such as elevators and top drives. The power lock system can consist of electrical, electronic, and/or mechanical devices or systems. The power lock system can be integrated with the PLC, and the PLC output device can execute the function by sending an output command to the actuator. The output command can be electrical, mechanical, hydraulic, pneumatic, or some combination. An example of a schematic of power lock system integrated with the PLC and used for either a CRT/CDS or any rig handling equipment is shown in FIG. 2.

The power lock system can enforce a condition that the states of two mechanisms or functions are mutually dependent. The two mechanisms considered are not limited to CRT/CDS Not Engaged to Tubular and Powerslip in Slip Up position; Elevator tilt arm on CRT not activated with powerslip in Slip Up Position, Rig handling tool not engaged, and Powerslip in Slip Up position, and so on.

The power lock system can be designed to prevent undesired states such as CRT/CDS slip and tubular caught by the powerslip during pick of the tubular string from the casing slips or tubular slip, and Drop in hole resulting in extensive fishing operation during deployment while trying to pick up or set in tubular in slips. As a result, the power lock system allows two independent functions to be engaged at the same time but does not permit the two systems to be disengaged at the same time. The power lock system provides conditions that must be TRUE in all cases in order for a particular output to be allowed by the PLC integrated with the Lock system. This will prevent operator error that can result casing drop incidents into a wellbore, as there is no system available in conventional systems to monitor weight transfer from the handling tool to the powerslip or casing spider.

The power lock system will not disengage the powerslip from the Slip Up position as long as there is weight on the slips above the preset value. The power lock system will also not allow CRT/CDS or rig handling tool to be released if weight has not been fully transferred to the powerslip in the Slip Up position.

In addition, the power lock system will only function if, in addition to the full weight transfer from the handling tool to the powerslip, it has been confirmed that the slips are fully engaged. This can eliminate the risk of tubular slip and drop through the rotary even with interlock system where the FMS closing on an obstruction is not limited, for example, to connection or centralizer.

FIG. 2 is a schematic diagram showing an example of a powerslip system 200 set up as a power lock and powerslip PLC system, according to some implementations of the present disclosure. FIG. 2 shows a power slip 202 in a rotary, an individual piston 203 for the retractable slips of an actuator 207, a retractable slips system 204 of a grappling device 205, an electrical control unit 206 for the retractable slips system, and a weight sensor system 208.

The powerslip system 200 provides a connection 210 from a CRT or rig handling system, allowing received data and instructions to be processed by a power lock interlock system 212 in a powerlock 211 (powered by power units 213), also receiving inputs from a power slip control panel unit 218. A powerslip PLC system 220 can provide logic control for the power slip control panel unit 218. The power lock interlock system 212 can identify power slips not engaged 214 and power slips engaged 216.

The powerslip PLC system 220, described in more detail with reference to FIG. 4, can include at least one processor, memory, a storage device, and an input/output device. The components can be interconnected using a system bus.

Figure 3:
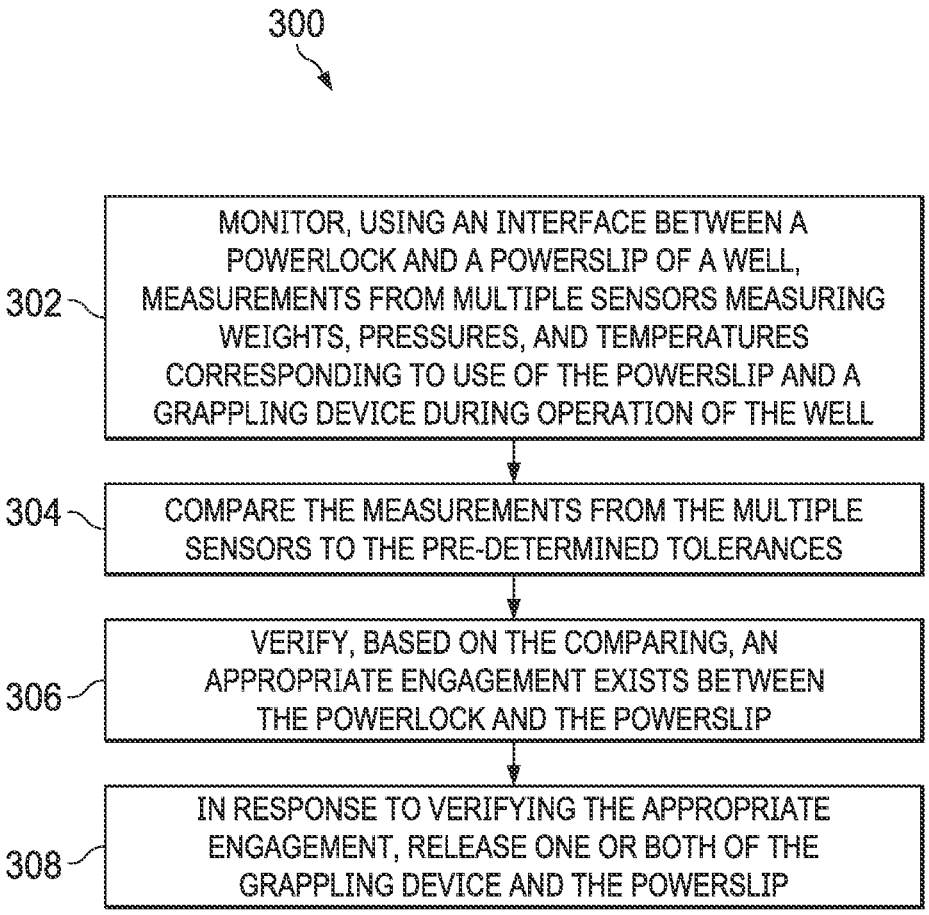
FIG. 3 is a flowchart showing an example of a method for an intelligent powerslip including interfacing with a powerlock system, according to some implementations of the present disclosure.

FIG. 3 is a flowchart showing an example of a method 300 for an intelligent powerslip including interfacing with a powerlock system, according to some implementations of the present disclosure. For clarity of presentation, the description that follows generally describes method 300 in the context of the other figures in this description. However, it will be understood that method 300 can be performed, for example, by any suitable system, environment, software, and hardware, or a combination of systems, environments, software, and hardware, as appropriate. In some implementations, various steps of method 300 can be run in parallel, in combination, in loops, or in any order.

At 302, measurements from multiple sensors are monitored using an interface between a powerlock and a powerslip of a well. The measurements measure weights, pressures, and temperatures corresponding to use of the powerslip and a grappling device during operation of the well. The multiple sensors can include, for example, weight sensors, location indicator sensors of retractable slips, and pressure and temperature sensors from actuator control lines, and wherein the multiple sensors provide pressure and temperature readings on power units 213, return lines 215, at least one powerslip 202, manifolds, accumulators and reducers, and fluid flow measurements. From 302, method 300 proceeds to 304.

At 304, the measurements from the multiple sensors are compared to pre-determined tolerances. For example, the PLC 128 can compare parameters 104-124 to acceptable values stored by the PLC. The values can continuously be obtained and monitored during execution of the workflow 100. From 304, method 300 proceeds to 306.

At 306, an appropriate engagement exists between the powerlock and the powerslip is verified based on the comparing. For example, decision points (e.g., 140, 142, 144, 156, 158, and 164) in the workflow 100 can be used to monitor engagements of equipment such as the powerslip. From 306, method 300 proceeds to 308.

At 308, in response to verifying the appropriate engagement, one or both of the grappling device and the powerslip are released. For example, using the power slip control pane unit 218, the grappling device and the powerslip can be released.

In some implementations, method 300 further includes providing, by an output device of a programmable logic controller (PLC), an output command to cause execution of a particular function by an actuator used at the well. For example, the output command is an electrical command, a mechanical command, a hydraulic command, a pneumatic command, or a combination of commands.

In some implementations, method 300 further includes providing, by an output device of the PLC, feedback to an operator regarding an alarm associated with a change in state of the powerslip or the powerlock. For example, the feedback provided to the operator regarding the change in state can be one or both of and audible sound and a visual indicator.

In some implementations, method 300 further includes providing, by an output device of the PLC, a user interface displaying current states of the powerslip and the powerlock. After 308, method 300 can stop.

Figure 4:
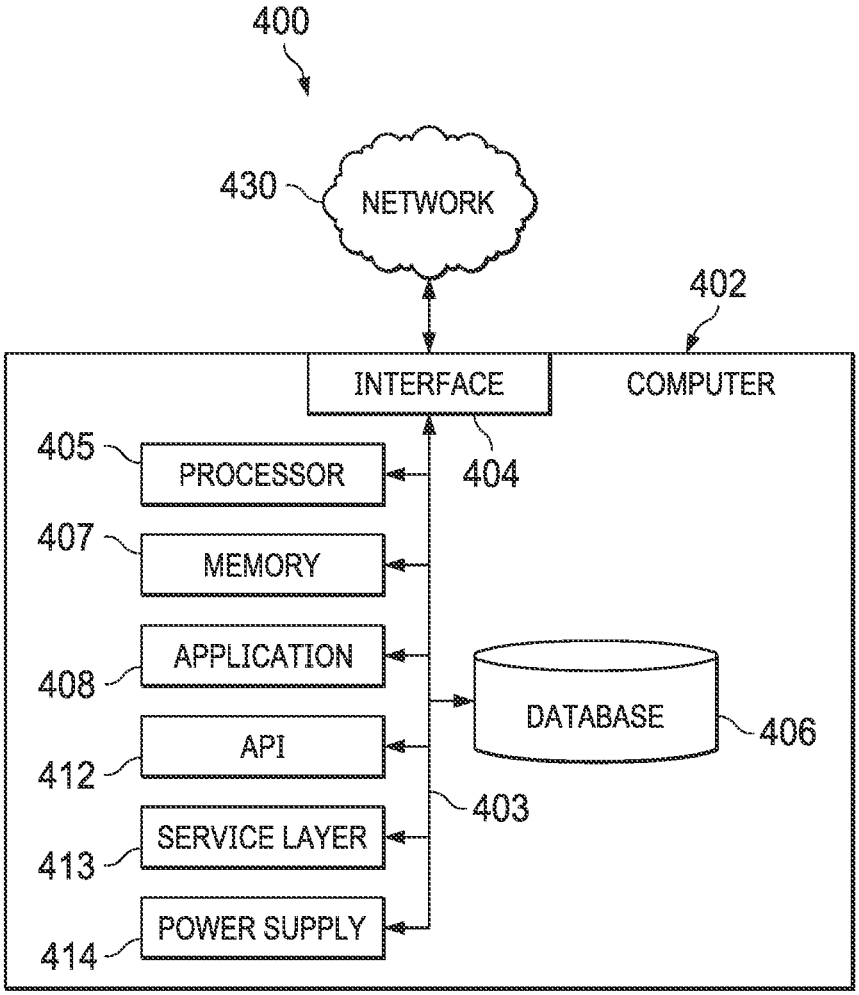
FIG. 4 is a block diagram illustrating an example computer system used to provide computational functionalities associated with described algorithms, methods, functions, processes, flows, and procedures as described in the present disclosure, according to some implementations of the present disclosure.

FIG. 4 is a block diagram showing an example computer system 400 used to provide computational functionalities associated with described algorithms, methods, functions, processes, flows, and procedures described in the present disclosure, according to some implementations of the present disclosure. The illustrated computer 402 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. Also, the computer 402 can include output devices that can convey information associated with the operation of the computer 402. The information can include digital data, visual data, audio information, or a combination of information. The information can be presented in a graphical user interface (UI) (or GUI).

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a top level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus 403. In some implementations, any or all of the components of the computer 402, including hardware or software components, can interface with each other or the interface 404 (or a combination of both) over the system bus 403. Interfaces can use an application programming interface (API) 412, a service layer 413, or a combination of the API 412 and service layer 413. The API 412 can include specifications for routines, data structures, and object classes. The API 412 can be either computer-language independent or dependent. The API 412 can refer to a complete interface, a single function, or a set of APIs.

The service layer 413 can provide software services to the computer 402 and other components (whether illustrated or not) that are communicably coupled to the computer 402. The functionality of the computer 402 can be accessible for all service consumers using this service layer. Software services, such as those provided by the service layer 413, can provide reusable, defined functionalities through a defined interface. For example, the interface can be software written in JAVA, C++, or a language providing data in extensible markup language (XML) format. While illustrated as an integrated component of the computer 402, in alternative implementations, the API 412 or the service layer 413 can be stand-alone components in relation to other components of the computer 402 and other components communicably coupled to the computer 402. Moreover, any or all parts of the API 412 or the service layer 413 can be implemented as child or sub-modules of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and can manipulate data to perform the operations of the computer 402, including operations using algorithms, methods, functions, processes, flows, and procedures as described in the present disclosure.

The computer 402 also includes a database 406 that can hold data for the computer 402 and other components connected to the network 430 (whether illustrated or not). For example, database 406 can be an in-memory, conventional, or a database storing data consistent with the present disclosure. In some implementations, database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality.

While memory 407 is illustrated as an internal component of the computer 402, in alternative implementations, memory 407 can be external to the computer 402.

The application 408 can be an algorithmic software engine providing functionality according to particular needs, desires, or particular implementations of the computer 402 and the described functionality. For example, application 408 can serve as one or more components, modules, or applications. Further, although illustrated as a single application 408, the application 408 can be implemented as multiple applications 408 on the computer 402. In addition, although illustrated as internal to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power-supply 414 can include a power plug to allow the computer 402 to be plugged into a wall socket or a power source to, for example, power the computer 402 or recharge a rechargeable battery.

There can be any number of computers 402 associated with, or external to, a computer system containing computer 402, with each computer 402 communicating over network 430. Further, the terms "client," "user," and other appropriate terminology can be used interchangeably, as appropriate, without departing from the scope of the present disclosure. Moreover, the present disclosure contemplates that many users can use one computer 402 and one user can use multiple computers 402.

Described implementations of the subject matter can include one or more features, alone or in combination.

For example, in a first implementation, a computer-implemented method includes the following. Measurements from multiple sensors are monitored using an interface between a powerlock and a powerslip of a well. The measurements measure weights, pressures, and temperatures corresponding to use of the powerslip and a grappling device during operation of the well. The measurements from the multiple sensors are compared to pre-determined tolerances to verify that an appropriate engagement exists between the powerlock and the powerslip. In response to verifying the appropriate engagement, one or both of the grappling device and the powerslip are released.

The foregoing and other described implementations can each, optionally, include one or more of the following features:

A first feature, combinable with any of the following features, the method further including providing, by an output device of a programmable logic controller (PLC), an output command to cause execution of a particular function by an actuator used at the well.

A second feature, combinable with any of the previous or following features, where the output command is an electrical command, a mechanical command, a hydraulic command, a pneumatic command, or a combination of commands.

A third feature, combinable with any of the previous or following features, where the multiple sensors include weight sensors, location indicator sensors of retractable slips, and pressure and temperature sensors from actuator control lines, and wherein the multiple sensors provide pressure and temperature readings on power units, return lines, powerslips, manifolds, accumulators and reducers, and fluid flow measurements.

A fourth feature, combinable with any of the previous or following features, the method further including providing, by an output device of the PLC, feedback to an operator regarding an alarm associated with a change in state of the powerslip or the powerlock.

A fifth feature, combinable with any of the previous or following features, where the feedback provided to the operator regarding the change in state is one or both of and audible sound and a visual indicator.

A sixth feature, combinable with any of the previous or following features, the method further including providing, by an output device of the PLC, a user interface displaying current states of the powerslip and the powerlock.

In a second implementation, a non-transitory, computer-readable medium stores one or more instructions executable by a computer system to perform operations including the following. Measurements from multiple sensors are monitored using an interface between a powerlock and a powerslip of a well. The measurements measure weights, pressures, and temperatures corresponding to use of the powerslip and a grappling device during operation of the well. The measurements from the multiple sensors are compared to pre-determined tolerances to verify that an appropriate engagement exists between the powerlock and the powerslip. In response to verifying the appropriate engagement, one or both of the grappling device and the powerslip are released.

The foregoing and other described implementations can each, optionally, include one or more of the following features:

A first feature, combinable with any of the following features, the operations further including providing, by an output device of a programmable logic controller (PLC), an output command to cause execution of a particular function by an actuator used at the well.

A second feature, combinable with any of the previous or following features, where the output command is an electrical command, a mechanical command, a hydraulic command, a pneumatic command, or a combination of commands.

A third feature, combinable with any of the previous or following features, where the multiple sensors include weight sensors, location indicator sensors of retractable slips, and pressure and temperature sensors from actuator control lines, and wherein the multiple sensors provide pressure and temperature readings on power units, return lines, powerslips, manifolds, accumulators and reducers, and fluid flow measurements.

A fourth feature, combinable with any of the previous or following features, the operations further including providing, by an output device of the PLC, feedback to an operator regarding an alarm associated with a change in state of the powerslip or the powerlock.

A fifth feature, combinable with any of the previous or following features, where the feedback provided to the operator regarding the change in state is one or both of and audible sound and a visual indicator.

A sixth feature, combinable with any of the previous or following features, the operations further including providing, by an output device of the PLC, a user interface displaying current states of the powerslip and the powerlock.

In a third implementation, a computer-implemented system includes one or more processors and a non-transitory computer-readable storage medium coupled to the one or more processors and storing programming instructions for execution by the one or more processors. The programming instructions instruct the one or more processors to perform operations including the following. Measurements from multiple sensors are monitored using an interface between a powerlock and a powerslip of a well. The measurements measure weights, pressures, and temperatures corresponding to use of the powerslip and a grappling device during operation of the well. The measurements from the multiple sensors are compared to pre-determined tolerances to verify that an appropriate engagement exists between the powerlock and the powerslip. In response to verifying the appropriate engagement, one or both of the grappling device and the powerslip are released.

The foregoing and other described implementations can each, optionally, include one or more of the following features:

A first feature, combinable with any of the following features, the operations further including providing, by an output device of a programmable logic controller (PLC), an output command to cause execution of a particular function by an actuator used at the well.

A second feature, combinable with any of the previous or following features, where the output command is an electrical command, a mechanical command, a hydraulic command, a pneumatic command, or a combination of commands.

A third feature, combinable with any of the previous or following features, where the multiple sensors include weight sensors, location indicator sensors of retractable slips, and pressure and temperature sensors from actuator control lines, and wherein the multiple sensors provide pressure and temperature readings on power units, return lines, powerslips, manifolds, accumulators and reducers, and fluid flow measurements.

A fourth feature, combinable with any of the previous or following features, the operations further including providing, by an output device of the PLC, feedback to an operator regarding an alarm associated with a change in state of the powerslip or the powerlock.

A fifth feature, combinable with any of the previous or following features, where the feedback provided to the operator regarding the change in state is one or both of and audible sound and a visual indicator.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented method, comprising:

monitoring, using an interface between a powerlock and a powerslip of a well, measurements from sensors comprising weight sensors measuring weights, pressure sensors measuring pressures, and temperature sensors measuring temperatures corresponding to use of the powerslip and a grappling device during operation of the well, the measurements indicating a weight of a tubular being transferred between the grappling device and the, the weight sensors being included in the powerslip and communicating with a wireless weight sensor included in the grappling device comprising a case running tool or a casing drive system the powerslip comprising slips that are retractable between positions;

comparing the measurements from the sensors to predetermined tolerances;

preventing, while the grappling device is gripping a string and supporting a string weight of the string, a release of the grappling device in response to determining that the string weight of the string has not been fully transferred to the powerslip;

verifying, based on the monitoring and the comparing, an appropriate engagement exists between the powerlock and the powerslip, comprising verifying that the powerslip is well seated comprising that the powerslip is gripping the tubular of the string;

in response to verifying the appropriate engagement, releasing one of the grappling device and the powerslip;

providing, by an input/output device controlled by a programmable logic controller (PLC), feedback to a graphical user interface of an operator device regarding an alarm identifying changes in a state of the powerslip and the powerlock, the changes comprising:

a first change in the state of the powerslip, detected by location indicator sensors, and indicating that each of the slips of the powerslip has been fully retracted to an initial position, a second change in the state of the powerslip indicating that weight has been transferred to the powerslip, and a third change in the state of the powerslip indicating that no weight is supported by the powerslip;

determining that an input signal to the PLC is lost, the input signal comprising data indicative of positions of the slips of the powerslip; and in response to determining that the input signal to the PLC is lost, activating an override status to deactivate the grappling device and to maintain a status of the powerslip to engage the string for securing the string.

2. The computer-implemented method of claim 1, wherein releasing one of the grappling device and the powerslip comprises:

providing, based on the comparing, by the input/output device of the PLC, an output command to cause execution of a particular function by an actuator used at the well.

3. The computer-implemented method of claim 2, wherein the output command is an electrical command, a mechanical command, a hydraulic command, a pneumatic command, or a combination of commands.

4. The computer-implemented method of claim 2, further comprising providing, by the input/output device of the PLC, current states of the powerslip and the powerlock to the graphical user interface.

5. The computer-implemented method of claim 1, wherein the sensors provide one or more of weight, pressure and temperature readings on power units, return lines, at least one powerslip, and fluid flow measurements.

6. The computer-implemented method of claim 1, wherein the feedback provided to the graphical user interface of the operator device regarding the first, second, or third change in state is one or both of an audible sound and a visual indicator initiated by the alarm.

7. A non-transitory, computer-readable medium storing one or more instructions executable by a computer system to perform operations comprising:

monitoring, using an interface between a powerlock and a powerslip of a well, measurements from sensors comprising weight sensors measuring weights, pressure sensors measuring pressures, and temperature sensors measuring temperatures corresponding to use of the powerslip and a grappling device during operation of the well, the measurements indicating a weight of a tubular being transferred between the grappling device and the, the weight sensors being included in the powerslip and communicating with a wireless weight sensor included in the grappling device comprising a case running tool or a casing drive system the powerslip comprising slips that are retractable between positions;

comparing the measurements from the sensors to predetermined tolerances;

preventing, while the grappling device is gripping a string and supporting a string weight of the string, a release of the grappling device in response to determining that the string weight of the string has not been fully transferred to the powerslip;

verifying, based on the monitoring and the comparing, an appropriate engagement exists between the powerlock and the powerslip, comprising verifying that the powerslip is well seated comprising that the powerslip is gripping the tubular of the string;

in response to verifying the appropriate engagement, releasing one of the grappling device and the powerslip;

providing, by an input/output device controlled by a programmable logic controller (PLC), feedback to a graphical user interface of an operator device regarding an alarm identifying changes in a state of the powerslip and the powerlock, the changes comprising:

a first change in the state of the powerslip, detected by location indicator sensors, and indicating that each of the slips of the powerslip has been fully retracted to an initial position, a second change in the state of the powerslip indicating that weight has been transferred to the powerslip, and a third change in the state of the powerslip indicating that no weight is supported by the powerslip;

determining that an input signal to the PLC is lost, the input signal comprising data indicative of positions of the slips of the powerslip; and in response to determining that the input signal to the PLC is lost, activating an override status to deactivate the grappling device and to maintain a status of the powerslip to engage the string for securing the string.

8. The non-transitory, computer-readable medium of claim 7, wherein releasing one of the grappling device and the powerslip further comprises:

providing, based on the comparing, by the input/output device of the PLC, an output command to cause execution of a particular function by an actuator used at the well.

9. The non-transitory, computer-readable medium of claim 8, wherein the output command is an electrical command, a mechanical command, a hydraulic command, a pneumatic command, or a combination of commands.

10. The non-transitory, computer-readable medium of claim 7, wherein the sensors provide one or more of weight, pressure and temperature readings on power units, return lines, at least one powerslip, and fluid flow measurements.

11. The non-transitory, computer-readable medium of claim 7, wherein the feedback provided to the graphical user interface of the operator device regarding the first, second, or third change in state is one or both of an audible sound and a visual indicator initiated by the alarm.

12. The non-transitory, computer-readable medium of claim 11, the operations further comprising providing, by the input/output device of the PLC, current states of the powerslip and the powerlock to the graphical user interface.

13. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

monitoring, using an interface between a powerlock and a powerslip of a well, measurements from sensors comprising weight sensors measuring weights, pressure sensors measuring pressures, and temperature sensors measuring temperatures corresponding to use of the powerslip and a grappling device during operation of the well, the measurements indicating a weight of a tubular being transferred between the grappling device and the, the weight sensors being included in the powerslip and communicating with a wireless weight sensor included in the grappling device comprising a case running tool or a casing drive system, the powerslip comprising slips that are retractable between positions;

comparing the measurements from the sensors to predetermined tolerances;

preventing, while the grappling device is gripping a string and supporting a string weight of the string, a release of the grappling device in response to determining that the string weight of the string has not been fully transferred to the powerslip;

verifying, based on the monitoring and the comparing, an appropriate engagement exists between the powerlock and the powerslip, comprising verifying that the powerslip is well seated comprising that the powerslip is gripping the tubular of the string;

in response to verifying the appropriate engagement, releasing one of the grappling device and the powerslip;

providing, by an input/output device controlled by a programmable logic controller (PLC), feedback to a graphical user interface of an operator device regarding an alarm identifying changes in a state of the powerslip and the powerlock, the changes comprising:

a first change in the state of the powerslip, detected by location indicator sensors, and indicating that each of the slips of the powerslip has been fully retracted to an initial position, a second change in the state of the powerslip indicating that weight has been transferred to the powerslip, and a third change in the state of the powerslip indicating that no weight is supported by the powerslip;

determining that an input signal to the PLC is lost, the input signal comprising data indicative of positions of the slips of the powerslip; and in response to determining that the input signal to the PLC is lost, activating an override status to deactivate the grappling device and to maintain a status of the powerslip to engage the string for securing the string.

14. The computer-implemented system of claim 13, wherein releasing one of the grappling device and the powerslip further comprises:

providing, based on the comparing, by the input/output device of the PLC, an output command to cause execution of a particular function by an actuator used at the well.

15. The computer-implemented system of claim 14, wherein the output command is an electrical command, a mechanical command, a hydraulic command, a pneumatic command, or a combination of commands.

16. The computer-implemented system of claim 13, wherein the sensors provide one or more of weight, pressure and temperature readings on power units, return lines, at least one powerslip, and fluid flow measurements.

17. The computer-implemented system of claim 13, wherein the feedback provided to the graphical user interface of the operator device regarding the first, second, or third change in state is one or both of an audible sound and a visual indicator initiated by the alarm.

* * * * *